United States Patent [19]

Mason et al.

[11] 3,971,677

[45] July 27, 1976

[54] LOW EXPANSION ALLOYS

[75] Inventors: John Jefferson Mason, Essington; Peter John Penrice, Birmingham, both of England

[73] Assignee: The International Nickel Company, Inc., New York, N.Y.

[22] Filed: May 5, 1975

[21] Appl. No.: 574,587

Related U.S. Application Data

[63] Continuation-in-part of Ser. No. 507,947, Sept. 20, 1974, abandoned, which is a continuation-in-part of Ser. No. 437,657, Jan. 29, 1974.

[52] U.S. Cl. ..... 148/31; 75/122; 75/123 J; 75/123 K; 75/123 M; 75/124; 148/142; 148/158

[51] Int. Cl.[2] ..... C22C 38/08

[58] Field of Search ..... 75/122, 123 J, 123 K, 75/123 M, 124; 148/31, 142, 158

[56] References Cited

UNITED STATES PATENTS

| | | | |
|---|---|---|---|
| 2,018,520 | 10/1935 | Halliwell | 75/122 |
| 2,266,481 | 12/1941 | Talbot | 148/31 |
| 2,941,882 | 6/1960 | Franklin et al. | 75/123 K |

FOREIGN PATENTS OR APPLICATIONS

| | | | |
|---|---|---|---|
| 420,580 | 12/1934 | United Kingdom | 75/122 |

*Primary Examiner*—R. Dean
*Attorney, Agent, or Firm*—Miriam W. Leff; Ewan C. MacQueen

[57] ABSTRACT

Low expansion alloys consisting essentially of Ni-Fe-Ti and optionally containing Co and/or Nb are provided which in the as-cast, age hardened condition have a thermal expansion coefficient between 20° and 300°C of less than $6 \times 10^{-6}$/°C and a 0.2% proof stress at 20°C higher than 350 N/mm$^2$.

23 Claims, 2 Drawing Figures

LOW EXPANSION ALLOYS

This application is a continuation-in-part of application Ser. No. 507,947, filed Sept. 20, 1974, and now abandoned which in turn is a continuation-in-part of application Ser. No. 437,657, filed Jan. 29, 1974.

BACKGROUND OF THE INVENTION

This invention relates to low-expansion nickel-iron alloys and is particularly concerned with the provision of castings of such alloys, which in the as-cast form have high strength and low thermal expansion characteristics at service temperatures.

It is known that certain nickel-iron alloys have a remarkably low coefficient of thermal expansion such as, for example, an alloy of 36% nickel and 64% iron known under the trade name "Invar" which has a coefficient of thermal expansion approaching zero over the temperature range 0° to around 200°C. A major problem with low-expansion nickel-iron alloys is their low strength. One method by which the strength of such alloys can be increased is by addition of elements such as aluminum, titanium or niobium, and a subsequent ageing treatment.

Titanium has generally been added in amount of between 0.75% and 2.5% by weight to increase the strength of wrought alloys, and we have found that to achieve an increase in strength to comparable levels in cast alloys requires the addition of rather more titanium, that is, between 1.5 and 5% titanium by weight. However, as is well known, the increase in strength resulting from titanium additions is achieved at the expense of the low coefficient of thermal expansion which is increased in proportion to the increasing titanium content of the alloy.

Surprisingly we have now found that an optimum balance between high strength and a low coefficient of thermal expansion at temperatures in the range of 20° to 300°C can be achieved in a cast and aged nickel-iron alloy strengthened with titanium, by correlating the nickel and titanium contents and optional cobalt and niobium contents according to a specific relationship.

It is an object of the present invention to provide improved age-hardened iron-nickel-titanium alloys with predetermined low expansion characteristics which have high mechanical strength.

It is another object of this invention to provide low expansion iron-nickel-titanium alloys which may contain cobalt, and/or niobium and in which concentrations of nickel, cobalt, titanium and niobium are controlled and correlated.

It is a further object to provide low expansion iron-nickel-titanium alloys having in the as-cast and aged condition a linear thermal expansion coefficient between 20° and 300°C of less than about $6 \times 10^{-6}$/°C and preferably less than about $5 \times 10^{-6}$/°C, and a 0.2% proof stress at 20°C higher than about 350 N/mm$^2$.

A still further object is to provide an alloy having low expansivity and high strength at working temperatures which can be cast directly into intricately-shaped castings with good surface properties.

The invention also contemplates providing structural components of machinery, for example turbine shafts and blades, in which close dimensional tolerance must be maintained at temperatures up to about 500°C, made of cast, age-hardenable alloys.

Other objects and advantages will become apparent from the accompanying drawings and the following description and examples.

SUMMARY OF INVENTION

Figure 1:
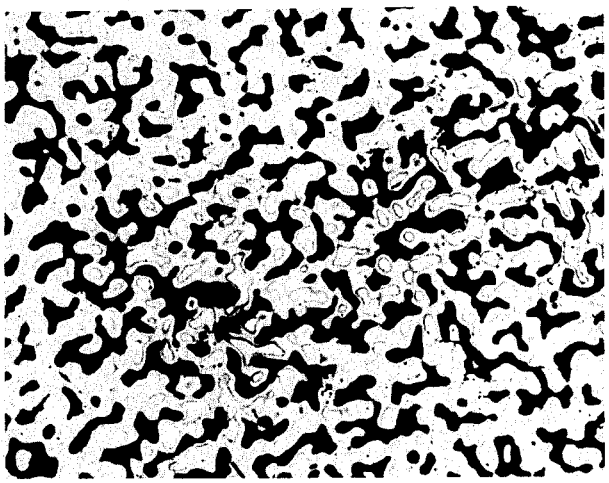
FIG. 1 is a photomicrograph at 100$x$ magnification showing the microstructure of a preferred alloy of the present invention, in the as-cast, age-hardened condition.

The present invention concerns castings made of a low expansion alloy which has in the as-cast condition dimensional stability over a wide temperature range despite the presence of segregation of major alloying elements.

Although the alloy can be solution treated, hot or cold worked, and otherwise treated to homogenize the material, it is a significant feature of the alloys that they can be cast and the castings, which are characterized by microsegregation, can be age-hardened directly without intermediate processing treatments to obtain useful products having a linear thermal expansivity over the temperature range 20° – 300°C. of less than $6 \times 10^{-6}$/°C., and preferably less than $5 \times 10^{-6}$/°C., and a 0.2% proof stress at 20°C. greater than about 350 N/mm$^2$ (Newtons per square millimeter). In the as-cast condition the microstructure of the alloy is characterized by a $Ni_3Ti$ precipitate and by substantial segregation of elemental constituents within the as-cast structure, but on the average the alloys consist essentially of, by weight, about 27% to about 47% nickel, up to about 16% cobalt, from about 1% to about 4% uncombined titanium, up to about 1.5% niobium, not more than about 0.1% carbon and the balance essentially iron. The correlation of nickel, cobalt, titanium and niobium contents and preferred embodiments are described in detail below.

DETAILED DESCRIPTION OF INVENTION

1. Alloy Composition

According to one aspect of the invention there is provided a nickel-containing alloy which in the as-cast and aged condition, has a thermal expansion coefficient between 20° and 300°C. of less than $6 \times 10^{-6}$/°C. and a 0.2% proof stress at 20°C. higher than 350 N/mm$^2$ consisting essentially of, by weight, up to about 16% cobalt, from about 1 to about 4% uncombined titanium, up to about 1.5% niobium, up to about % 5 carbon, the contents of nickel, cobalt, titanium and niobium being such that:

$$\%Ni + 0.7\ (\%Co) - 1.25\ [\%Ti + 0.35\ (\%Nb)] - 2\ (\%Ti)/(Ti + \%Nb) = 37 \text{ to } 40,$$

and the balance, apart from impurities and incidental constituents, being essentially iron. To satisfy the equation the nickel content is about 29% to about 47%.

According to another aspect of the invention there is provided a nickel-containing alloy which, when in the as-cast and aged condition, has a thermal expansion coefficient between 20° and 300°C. of less than $5 \times 10^{-6}$/°C. and a 0.2% proof stress at 20°C. higher than 350 N/mm$^2$, consisting essentially of, by weight, from above 5% up to about 16% cobalt, from about 1 to about 4% uncombined titanium, up to about 1.5% niobium, up to about 0.1% carbon, the contents of nickel, cobalt, titanium and niobium being such that:

$$\%Ni + 0.7\ (\%Co) - 1.25\ [\%Ti + 0.35\ (\%Nb)] - 2\ (\%Ti)/\ \%Ti + \%Nb) = 37 \text{ to } 39,$$

and the balance, apart from impurities and incidental constituents, being essentially iron. To satisfy the equation the nickel content is about 29% to about 43%.

Alloys according to the invention may also contain by weight, up to about 0.3% silicon, up to about 0.4% manganese, up to about 0.3% aluminum, and up to about 0.2% magnesium. The presence of silicon, manganese and/or aluminum is particularly beneficial when the alloys are to be produced by melting in air.

In preferred alloys according to the present invention the minimum cobalt content is above 5%. Cobalt reduces the thermal coefficient, particularly in the temperature range of about 300° to 600°C. Thus, for use at a temperature above about 300°C. the cobalt content should be greater than 5%. If the cobalt content exceeds about 16%, the expansion coefficient is increased. Advantageously, the cobalt content is in the range of from about 7% to about 14% and more preferably in the range of about 7.5% to about 8.5%, e.g. 8%. However, alloys may also contain, advantageously, about 10% to about 15% cobalt, depending on the nickel content.

The tensile strength of alloys according to the invention is thought to be a function of the titanium content. Approximately twice the level of titanium is required in the cast and aged alloy to give comparable strengths to similar alloys in the wrought and aged state. For example, an ironbase alloy containing nominally 34% nickel and 13% cobalt would require approximately 3% titanium to achieve in the cast condition the strength achieved in the wrought condition by the same ironbase alloy containing approximately 1.5% titanium. The alloys of this invention contain uncombined titanium in an amount of between about 1% and about 4% by weight, preferably above 1.75% up to about 2.7%, and more preferably between 1.9% and about 2.2%. Uncombined titanium contents of less than about 1% reduce the strength of the alloy and thereby of the casting made from the alloy, and uncombined titanium contents greater than about 4% unacceptably reduce the ductility of the casting made from the alloy and increase embrittlement.

The attainment of high strength in alloys used for castings according to the invention depends upon precipitation hardening by the formation of a precipitate, $Ni_3Ti$, when ageing the alloy casting at elevated temperature. Titanium combined with carbon will not enter this precipitate. For this reason it is the content of titanium that is not combined with carbon (referred to in this specification and claims as "uncombined titanium"), which is important. The total amount of titanium preferably exceeds the uncombined amount by four times the weight of the carbon content, which itself must not exceed 0.1%. Preferably carbon should not exceed 0.04%, e.g. it is lower than 0.02% or even lower than 0.002%.

Although niobium is not essential for obtaining the required properties, it can be added in an amount of up to 1.5% to help in the achievement of good mechanical properties.

The nickel content of alloys according to the invention is from about 27 to about 47%. However, preferred embodiments contain from about 29% to about 44%, and more preferred embodiments from about 32% to 38% nickel. Where the cobalt content is a minimum of 5%, the maximum nickel present is about 42.5 or 43% for alloys having an expansivity at 20° – 300°C of less than $5 \times 10^{-6}$/°C.

The correlation between the nickel and titanium contents in alloys of the invention is critical if the desired balance of strength and low expansion properties are to be achieved between 20 ° and 300°C. To this end the nickel, cobalt, titanium and niobium contents of the alloy should satisfy the following relationships:

$$\%Ni + 0.7\ (\%Co) - 1.25\ [\%Ti + 0.35\ (\%Nb)] - 2\ (\%Ti)/(\%Ti + \%Nb) = 37 \text{ to } 40 \quad (1)$$

or $$\%Ni + 0.7\ (\%Co) - 1.25\ [\%Ti + 0.35\ (\%Nb)] - 2\ (\%Ti)/(\%Ti + \%Nb) = 37 \text{ to } 39 \quad (2)$$

Cast and aged alloys which do not satisfy the foregoing relationships, while possibly having a 0.2% proof stress at 20°C higher than 350 N/mm² dependng upon their titanium content will not also have the desired thermal expansion coefficient between 20°and 300°C of less than $6 \times 10^{-6}$/°C for relationship (1) and less than $5 \times 10^{-6}$/°C for relationship (2).

Experiments have shown that for iron-base alloys containing nominally 2.5% titanium and 13.5% cobalt it is necessary to have a nickel content of between approximately 32.5% and approximately 34.5% in order to maintain in the cast and aged condition a mean coefficient of thermal expansion between 20°C and 300°C of less than $5 \times 10^{-6}$/°C. If the nickel content falls below approximately 32.5% in the nominally 2.5% titanium, 13.5% cobalt alloy there is a possibility of martensite formation, which has a high coefficient of thermal expansion, by refrigerating or cold working. Nickel contents higher than approximately 34.5% in the nominally 2.5% titanium, 13.5% cobalt alloy result in thermal expansion coefficients greater than the desired $5 \times 10^{-6}$/°C. The nominal Ti content refers to total titanium, which since the carbon content is about 0.002%, is effectively the same as the uncombined titanium content.

To obtain good castings according to the invention it is preferable to control the silicon, manganese and aluminum content of the alloy from which the casting is made. Less than 0.3% and preferably less than 0.1% silicon in alloys used for castings according to the invention decreases the expansion coefficient. More than 0.3% silicon can increase the proof stress but undesirably increases the expansion coefficient. Manganese facilitates deoxidation, castability and improved proof stress but at the expense of increased expansion and for this reason the manganese content must not exceed 0.4% and for optimum proof stress and expansion properties preferably should not exceed 0.3%. Aluminum assists the production of castings by the air melting and air casting route. For this purpose it is advantageous for the alloy to contain at least 0.05% aluminum but it must not be present in quantities greater than 0.3% otherwise it increases the expansion coefficient. Preferably for optimum proof stress and expansion properties the aluminum content should not exceed 0.2%.

In preferred embodiments of this invention alloys used for castings, the nickel content preferably is from about 32% to about 38%, the cobalt content is from about 7% to about 14%, the uncombined titanium content is from above 1.75% up to about 2.7%, the carbon content does not exceed 0.04% and the manganese content does not exceed 0.3%. More preferably alloys used for castings according to the invention contain from about 36.5% to about 37.5% or 38% nickel, from about 7.5% to about 8.5% cobalt, from about 1.9% to about 2.2% uncombined titanium and from about 0.3% to about 0.6% niobium.

A particularly useful alloy for castings according to the invention contains about 37% or 37.5% nickel, about 8% cobalt, about 2% uncombined titanium, about 0.5% niobium, not more than about 0.04% carbon, not more than about 0.3% silicon, not more than about 0.3% aluminum and not more than about 0.3% manganese.

Although castings according to the invention can be produced by air melting and air casting, it is preferred to melt in vacuum or under an inert atmosphere. If alloys melted in air or under an inert atmosphere are used for making castings according to the invention the alloy preferably should contain not more than 0.1% magnesium to prevent gas evolution and porosity in the casting. The magnesium conveniently is added as a final deoxidant in the form of Ni-Mg.

2. Microstructure of Cast Alloys

As noted above, the present invention is concerned with cast alloys. Heretofore, many low expansion alloys were wrought alloys for which the desired properties have been developed after processing which consisted of casting, hot or cold working, solution treatment and final ageing. After such treatment the alloys consist of an essentially homogeneous matrix containing $Ni_3Ti$ precipitate. According to the present invention the alloy is a cast material which has the desired properties after simply ageing the casting, or even (as explained previously) in the as-cast condition. In the alloys of this invention the microstructure in the as-cast condition is inhomogeneous, there being a significant segregation of the major alloying elements, viz. Ni, Co, Fe and Ti. Because of the sensitivity of expansivity to compositional effects it is surprising that such inhomogeneous products have low expansivities.

The segregated character of the cast alloys of the present invention is illustrated in FIG. 1, which is a photomicrograph of an alloy having the composition of about 37.5% Ni, 8% Co, 2% Ti, 0.5% Nb and the balance Fe. The alloy was cast in a vacuum at a temperature in the range of 1500° to 1550°C and the casting given an ageing treatment of 650°C for 24 hours. The sample is etched with 5% Nital. Black areas in FIG. 1 represent interdendritic regions (last to solidify) and have the highest Ti content. White areas are regions containing the lowest Ti content, and grey areas have intermediate Ti content.

Figure 2:
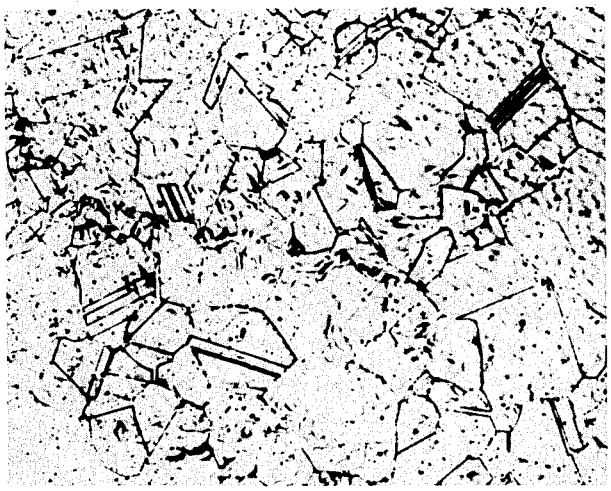
FIG. 2 is a photomicrograph at 100$x$ magnification showing the microstructure of an alloy of the same composition as FIG. 1, but with the casting given an homogenization treatment before it was age-hardened.

FIG. 2 is a photomicrograph of an alloy of essentially the same composition and preparation, except that before ageing, the cast material, a 3.5 inch diameter ingot, was forged at 1150°C to a 2 inch square bar, which was rod rolled at 1150°C to a 0.375 inch diameter rod. The photomicrograph was taken after heat treatment of the rod for 1 hour at 1050°C followed by the ageing treatment for 6 hours at 650°C.

The differences between the segregated and homogenized microstructures of the alloys is evident from FIGS. 1 and 2.

3. Casting Procedures

It is a significant feature of the present invention that the cast alloys can be age-hardened directly to achieve dimensionally stable castings having a thermal expansivity over a temperature range of 20° to 300°C of less than $6 \times 10^{-6}$/°C, and preferably less than $5 \times 10^{-6}$/°C and a 0.2 proof stress at 20°C greater than 350 N/mm$^2$.

Casting temperatures of about 1500°C to 1550°C have been found particularly suitable. However, casting temperatures for the alloys of this invention may range from about 1475°C to about 1600°C.

The ageing treatment preferably is carried out in the temperature range 550° to 700°C, for a time in the range of from about 1 to 24 hours, with the optimum temperature being dependent upon the titanium content of the alloy. For lower levels of uncombined titanium content, optimum properties may be achieved after heat treating at the lower end of the temperature range, e.g. 575° to 625°C for about 24 hours, whereas for higher levels of titanium content, a heat treatment of about 24 hours at the higher end of the temperature range e.g. 625° to 675°C, may give optimum properties. A heat treatment of 5 hours at 650°C results in a slightly higher expansion coefficient and a slightly lower proof stress, but where slightly inferior properties are acceptable a heat treatment of 5 hours at 650°C may be commercially more acceptable. Indeed, high strength and low expansion properties adequate for certain applications may be obtained without a separate ageing heat treatment, if the casting has a sufficiently large section and is cooled slowly enough through the ageing temperature range. Generally, the age-hardening can be applied to as-cast alloys or castings but if desired it can be preceded by solution heating.

Castings according to the invention can, if required, be intricately-shaped investment castings with good surface properties requiring little or no surface machining prior to use. Nickel-iron-cobalt castings which are not strengthened are prone to surface cracking due in part to "hot shortness" and in part to poor oxidation resistance. The presence of such cracks can severely limit or reduce mechanical properties, such as fatigue life, and their presence, particularly in investment castings, is undesirable. The presence of titanium in nickel-iron-cobalt alloys used for the castings of the invention limits the incidence of cracking due to hot shortness and poor oxidation resistance, and such castings have good surface finishes in comparison with castings lacking in titanium. These good surface properties are particularly noticeable in castings according to the invention made from alloys containing high uncombined titanium levels (e.g. 2% and above).

For a better understanding of the invention reference should be made to the following Examples.

EXAMPLE I

An Alloy 1 of compsotion, composition, weight, 33% nickel, 13.4% cobalt, 2.5% uncombined titanium, less than 0.002% carbon, $\%Ni + 0.7\ (\%C0) - 1.25\ [\%Ti + 0.35\ (\%Nb)] - 2\ (\%Ti)/(\%Ti + Nb) = 37.26$ balance, apart from impurities being iron, was vacuum melted and investment cast in vacuum at 1500°C to a casting according to the invention. The casting was given an ageing heat treatment at 650°C. for 24 hours and when tested had the properties shown in Tables 1 and 2.

TABLE 1

| Test Temperature | Tensile Properties (N/mm²) U.T.S. (1) | 0.2% P.S. (2) | Elongation (%) |
|---|---|---|---|
| (°C) | | | |
| 20 | 890 | 750 | 4 |
| 500 | 610 | 500 | 9 |

(1) Ultimate Tensile Strength
(2) Proof Stress
(N/mm²) = Newtons per square millimeter

TABLE 2

| Test Temperature Range (°C) | Coefficient of Thermal Expansion (per °C) |
|---|---|
| 20 - 100 | $4.2 \times 10^{-6}$ |
| 20 - 200 | $3.8 \times 10^{-6}$ |
| 20 - 300 | $3.9 \times 10^{-6}$ |
| 20 - 400 | $5.5 \times 10^{-6}$ |
| 20 - 500 | $7.4 \times 10^{-6}$ |
| 20 - 600 | $9.1 \times 10^{-6}$ |

From the results of Example I it can be seen that a casting according to the invention would have a thermal expansion coefficient over the range 20° to 300°C of less than $5 \times 10^{-6}$/°C and a 0.2% proof stress at 20°C higher than 350 N/mm².

EXAMPLE II

An Alloy 2 of nominal composition, by weight, 37% nickel, 8% cobalt, 2.1% uncombined titanium, 0.002% carbon, %Ni + 0.7 (%Co) − 1.25 [%Ti + 0.35 (%Nb)]− 2 (%Ti)/(%Ti + %Nb) = 37.97 balance, apart from impurities, being iron, was vacuum melted and investment cast in vacuum to a casting according to the invention. The casting was given an ageing heat treatment at 650°C for 24 hours and when tested had the properties shown in Tables 3 and 4.

TABLE 3

| Test Temperature (°C) | Elongation (%) | Tensile Properties (N/mm²) U.T.S. | 0.2% P.S. |
|---|---|---|---|
| 20 | 7 | 820 | 680 |
| 500 | 11 | 700 | 490 |

TABLE 4

| Test Temperature Range (°C) | Coefficient of Thermal Expansion (per °C) |
|---|---|
| 20 - 100 | $4.6 \times 10^{-6}$ |
| 20 - 200 | $4.3 \times 10^{-6}$ |
| 20 - 300 | $4.3 \times 10^{-6}$ |
| 20 - 350 | $4.6 \times 10^{-6}$ |
| 20 - 400 | $5.6 \times 10^{-6}$ |
| 20 - 500 | $7.7 \times 10^{-6}$ |
| 20 - 600 | $9.4 \times 10^{-6}$ |

Once again the results of Example II show that a casting according to the invention would have a thermal expansion coefficient over the range 20° to 300°C of less than $5 \times 10^{-6}$/°C and a 0.2% proof stress at 20°C higher than 350 N/mm².

A particularly preferred alloy composition range from which castings according to the invention can be made is, by weight, 36.5% to 37.5% nickel, 7.5% to 8.5% cobalt, 1.9% to 2.2% uncombined titanium, 0.3% to 0.6% niobium, not more than 0.04% carbon, not more than 0.3% silicon, not more than 0.2% aluminum, not more than 0.3% manganese, balance, apart from impurities, being iron. Test results of a casting made from such an alloy are described in the following Example III.

EXAMPLE III

An Alloy 3 of composition, by weight, 37.3% nickel, 7.9% cobalt, 2.02% uncombined titanium, 0.54% niobium, 0.002% carbon, 0.05% aluminum, %Ni + 0.7 (%Co) − 1.25 [%Ti + 0.35 (%Nb)] − 2 (%Ti)/(%Ti + %Nb) = 38.49, balance, apart from impurities, being iron was vacuum melted and investment cast in vacuum at a temperature in the range of 1500° to 1550°C to a casting according to the invention. The casting was given an ageing heat treatment in air at 650°C for 24 hours and when tested had the properties shown in Tables 5 and 6.

TABLE 5

| Test Temperature (°C) | Tensile Properties (N/mm²) U.T.S. | 0.2% P.S. | Elongation (%) |
|---|---|---|---|
| 20 | 820 | 710 | 5 |
| 500 | 650 | 510 | 9 |

TABLE 6

| Test Temperature Range (°C.) | Coefficient of Thermal Expansion (per °C.) |
|---|---|
| 20 - 100 | $4.3 \times 10^{-6}$ |
| 20 - 200 | $4.5 \times 10^{-6}$ |
| 20 - 300 | $4.6 \times 10^{-6}$ |
| 20 - 350 | $4.9 \times 10^{-6}$ |
| 20 - 400 | $6.0 \times 10^{-6}$ |

The results of Example III clearly show that a casting according to the invention would have a thermal expansion coefficient over the range 20° to 300°C. of less than $5 \times 10^{-6}$/°C. and a 0.2% proof stress at 20°C. higher than 350 N/mm².

EXAMPLE IV

Alloys 7, 8, 9 and 10, having the compositions shown in Table 7 were vacuum melted and investment cast, and each casting was given an ageing treatment in air at 650°C. for 24 hours. The composition factors and the coefficients of thermal expansion (over 20° - 300°C.) are given in Table 7.

TABLE 7

| Alloy | Composition (wt.%) Ni | Co | Ti | C | Fe | Composition Factor* | Coeff. of Thermal Expansion/°C. |
|---|---|---|---|---|---|---|---|
| 7 | 38.3 | 7.9 | 2.0 | 0.002 | Bal. | 39.3 | $5.6 \times 10^{-6}$ |
| 8 | 39.4 | 7.8 | 2.0 | 0.002 | Bal. | 40.4 | $6.0 \times 10^{-6}$ |
| 9 | 34 | 15.1 | 1.80 | 0.002 | Bal. | 40.3 | $6.7 \times 10^{-6}$ |

TABLE 7-continued

| Alloy | Composition (wt.%) Ni | Co | Ti | C | Fe | Composition Factor* | Coeff. of Thermal Expansion/°C. |
|---|---|---|---|---|---|---|---|
| 10 | 27.4 | 10.9 | 1.78 | 0.002 | Bal. | 30.8 | $7.2 \times 10^{-6}$ |

*Composition factor = %Ni + 0.7 (%Co) − 1.25[%Ti + 0.35 (%Nb)] − 2 (%Ti)/(%Ti + %Nb)

Comparison of results of tests on expansivity of Alloys 7, 8, 9, and 10 with alloys 1, 2, and 3 illustrates the criticality of composition on expansion.

Tests on alloys in accordance with the present invention show that such alloys have a 0.2% P.S. at 500°C. greater than 200 N/mm² and an expansivity in the temperature range of 20° – 350°C. less than $6.5 \times 10^{-6}$/°C. Preferred alloys, e.g. as illustrated in Examples II and III have an expansivity in the temperature range of 20° – 350°C. of less than $5 \times 10^{-6}$/°C.

Castings according to the invention are particularly useful for structural components which reach high temperatures in use and must have such a combination of low expansivity and high strength at working temperatures. Such structural components include parts of rotating and reciprocating machinery, for example, turbine shafts and blades, in which close dimensional tolerances have to be maintained under varying temperatures from ambient temperature up to 300°C. or even higher, for example up to 500°C. These requirements arise in a particularly acute form in high efficiency propulsion machinery for land, sea and air uses. Examples of uses of castings according to the invention are as marine diesel piston crowns and as die materials for aluminum casting.

It has been found that castings according to the present invention are particularly useful for high efficiency propulsion machinery operating at temperatures in the range of 200°C. to 500°C. or 600°C. and service speeds of the order of 9000 rpm or even higher. For example, alloys of the present invention are especially useful as precision cast machine parts, e.g. a rotor or rotor blades for supercharging an internal combustion engine. Moreover, it has been found that the castings prepared from the present alloys maintain dimensional stability when used for adjoining thick and thin sections which must be resistant to hot tearing at the junctures when subjected in use to high centrifugal stresses, thermal cycling and temperature gradients. Since suitable properties can be achieved during cooling or with only simple ageing treatment the risk of distortion associated with subsequent quenching and solution treatment is avoided and the product can be provided at lower cost. It has also been found that castings made from the present alloys can withstand such treatment in the presence, simultaneously, of oxidizing and hydrocarbon combustion product atmospheres. Thus, in addition to having suitable properties of expansivity and strength, which are vital for efficiency of rotor blades, the present alloys satisfy the requirements of good castability and resistance to the complex and dynamic environment.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and appended claims.

What is claimed is:

1. A metallic cast article adapted to be employed under stress at temperatures in excess of ambient temperature and having enhanced utility by virtue of dimensional stability over the temperature range from ambient temperature to at least 300°C and high strength and consisting of an alloy having an as-cast and age-hardened microstructure, said microstructure being characterized by a $Ni_3Ti$ precipitate and by substantial segregation of elemental constituents within the as-cast structure but, on the average consisting essentially, in percent by weight, of about 27% to about 47% nickel, about 1% to about 4% uncombined titanium, up to about 16% cobalt, up to about 1.5% niobium, up to about 0.1% carbon, with the balance, except for impurities and incidental elements being essentially iron, to provide in said as-cast plus age-hardened alloy a linear thermal expansion coefficient between 20°C and 300°C of less than about $6 \times 10^{-6}$/°C and a 0.2% proof stress at 20°C greater than about 350 N/mm².

2. A metallic cast article according to claim 1, wherein the alloy contains up to about 0.3% silicon, up to about 0.4% manganese, up to about 0.3% aluminum, and up to about 0.2% magnesium.

3. A metallic cast article according to claim 1, wherein the alloy contains about 29% to about 47% nickel and the nickel, cobalt, titanium and niobium contents are correlated such that:

$$\%Ni + 0.7\ (\%Co) - 1.25\ [\%Ti + 0.35\ (\%Nb)] - 2\ (\%Ti)/(\%Ti + \%Nb) = 37 \text{ to } 40.$$

4. A metallic cast article according to claim 1, wherein the nickel content is about 29% to about 44%, and the nickel, cobalt, titanium and niobium contents are correlated such that:

$$\%Ni + 0.7\ (\%Co) - 1.25\ [\%Ti + 0.35\ (\%Nb)] - 2\ (\%Ti)/(\%Ti + \%Nb) = 37 \text{ to } 39,$$

and wherein said alloy has a linear thermal coefficient of expansion between 20° and 300°C. of less than about $5 \times 10^{-6}$/°C.

5. A metallic cast article adapted to be employed under stress at temperatures in excess of ambient temperature and having enhanced utility by virtue of dimensional stability over the temperature range from ambient temperature to at least 300°C. and high strength and consisting of an alloy having an as-cast and age-hardened microstructure, said microstructure being characterized by a $Ni_3Ti$ precipitate and by substantial segregation of elemental constituents within the as-cast structure but on the average consisting essentially, in percent by weight, of about 32% to about 38% nickel, from above 1.75% to about 2.7% uncombined titanium, from about 7 to about 14% cobalt, up to about 1.5% niobium, up to about 0.04% carbon, with the balance, except for impurities and incidental elements being essentially iron, said nickel, cobalt, titanium and niobium contents being correlated such that:

$$\%Ni + 0.7\ (\%Co) - 1.25\ [\%Ti + 0.35\ (\%Nb)] - 2\ (\%Ti)/(\%Ti + Nb) = 37 \text{ to } 39,$$

to provide in said as-cast age-hardened alloy a linear thermal expansion coefficient between 20°C and 300°C of less than about $5 \times 10^{-6}$/°C and a 0.2% proof stress at 20°C greater than about 350 N/mm².

6. A metallic cast article according to claim 5, wherein the alloy contains up to about 0.3% silicon, up to about 0.3% manganese, up to about 0.3% aluminum and up to about 0.1% magnesium.

7. A metallic cast article according to claim 5, wherein the alloy contains from about 36.5% to about 38% nickel, about 7.5% to about 8.5% cobalt, from about 1.9% to about 2.2% uncombined titanium, and about 0.3% to about 0.6% niobium.

8. A metallic cast article according to claim 7, wherein the alloy contains from about 36.5% to about 37.5% nickel.

9. A metallic cast article according to claim 8, wherein the alloy contains about 8% cobalt, about 2% uncombined titanium, and up to about 0.002% carbon.

10. A metallic cast article according to claim 9, wherein the alloy contains about 0.5% niobium.

11. A metallic cast article according to claim 5, wherein the alloy contains about 32.5% to about 34.5% nickel, about 2.5% uncombined titanium, and about 13.5% cobalt.

12. A precision cast rotor having adjoining thick and thin sections which are resistant to hot tearing at the junctures, said rotor being subjected in use to high centrifugal stresses, thermal cycling, temperature gradients, and simultaneously to oxidizing and hydrocarbon combustion product atmospheres, said rotor being made of a low expansion alloy cast at elevated temperatures and cooled, the alloy having a composition consisting essentially of, by weight, from about 32% to about 38% nickel, from above 1.75% to about 2.7% uncombined titanium, from about 7% to about 16% cobalt, up to about 1.5% niobium, up to about 0.04% carbon, up to about 0.3% silicon, up to about 0.3% manganese, up to about 0.3% aluminum, up to about 0.1% magnesium, and the balance, apart from impurities and incidental constituents, being essentially iron, and said alloy having in the as-cast, age-hardened condition an expansivity of less than about $5 \times 10^{-6}$/°C. over a temperature range of 20° to 300°C. and a 0.2% proof stress at 20°C. higher than about 350 N/mm².

13. A precision cast rotor according to claim 12, wherein the alloy contains about 36.5% to about 38% nickel, 7.5% to about 8.5% cobalt, from about 1.9% to about 2.2% titanium, and about 0.3% to about 0.6% niobium, up to about 0.1% silicon, and up to about 0.2% aluminum.

14. A shaped casting made of an alloy consisting essentially of, by weight, from about 29% to about 47% nickel, from about 1% to about 4% titanium, up to about 16% cobalt, up to about 1.5% niobium, and the balance, apart from impurities and incidental constituents, being essentially iron, and said contents of nickel, cobalt, titanium and niobium being such that:

$$\%Ni + 0.7\ (\%Co) - 1.25\ [\%Ti + 0.35\ (\%Nb)]\ 2\ (\%Ti)/(\%Ti + \%Nb) = 37 \text{ to } 40,$$

said shaped casting being prepared by forming the alloy into a shaped casting and subjecting said casting directly to age-hardening conditions to obtain a shaped casting having in the as-cast age-hardened condition a thermal coefficient of expansion between about 20°C to about 300°C of less than about $6 \times 10^{-6}$/°C and a 0.2% proof stress at 20°C greater than about 350 N/mm².

15. A shaped casting according to claim 14 wherein the contents of nickel, cobalt, titanium and niobium are such that:

$$\%Ni + 0.7\ (\%Co) - 1.25\ [\%Ti + 0.3\ (\%Nb)] - 2\ (\%Ti)/(\%Ti + \%Nb) = 37 \text{ to } 39,$$

and wherein said thermal coefficient of expansion in the as-cast age-hardened condition is less than $5 \times 10^{-6}$/°C.

16. A shaped casting according to claim 14 wherein the cobalt content of the alloy is from above 5% to about 16%.

17. A shaped casting according to claim 14 wherein the nickel content of the alloy is about 32% to about 38%.

18. A shaped casting according to claim 14 wherein the titanium content of the alloy is from above 1.75% to about 2.7%.

19. A shaped casting according to claim 17 wherein the alloy contains about 7.5% to about 8.5% cobalt, about 1.9% to about 2.2% titanium, and about 0.3 to about 0.6% niobium.

20. A shaped casting according to claim 14 wherein the alloy contains up to about 0.3% Si, up to about 0.4% manganese, up to about 0.3% aluminum, and not more than about 0.1% carbon.

21. A shaped casting according to claim 14 wherein the age-hardening treatment is carried out in the temperature range of about 550° to about 700°C.

22. A shaped casting according to claim 14 wherein the alloy is investment cast to form the shaped casting and the investment casting is subjected directly to an age-hardening treatment at a temperature in the range of 550°C to 700°C.

23. A shaped casting made of an alloy consisting essentially of, by weight, about 29 to about 43% nickel, from about 1% to about 4% titanium, from above 5% to about 16% cobalt, up to about 1.5% niobium, and the balance, apart from impurities and incidental constituents, being essentially iron and said contents of nickel, cobalt, titanium and niobium being such that:

$$\%Ni + 0.7\ (\%Co) - 1.25\ [\%Ti + 0.35\ (\%Nb)] - 2\ (\%Ti)/(\%Ti + \%Nb) = 37 \text{ to } 40,$$

said shaped casting being prepared by forming the alloy into a shaped casting at a casting temperature of about 1500° to about 1550°C and subjecting said casting directly to age-hardening conditions at a temperature of about 550° to about 700°C to obtain a shaped casting having in the as-cast age-hardened conditions condition a microstructure characterized by a $Ni_3Ti$ precipitate and by substantial segregation of elemental constituents within the as-cast structure and said as-cast age-hardened alloy having a linear thermal coefficient of expansion between about 20°C to about 300°C of less than about $6 \times 10^{-6}$/°C and a 0.2% proof stress at 20°C greater than about 350 N/mm².

* * * * *